United States Patent [19]

Ladd et al.

[11] Patent Number: 4,684,401

[45] Date of Patent: Aug. 4, 1987

[54] CHROMIUM-COBALT FINE ALLOY POWDER AND PROCESS FOR PRODUCING SAME

[75] Inventors: Judith A. Ladd, Sayre; Clarence D. Vanderpool, Towanda, both of Pa.

[73] Assignee: GTE Products Corporation, Stamford, Conn.

[21] Appl. No.: 861,884

[22] Filed: May 12, 1986

[51] Int. Cl.[4] ..... B22F 1/00

[52] U.S. Cl. ..... 75/0.5 BA; 75/251

[58] Field of Search ..... 75/0.5 BA, 251

[56] References Cited

U.S. PATENT DOCUMENTS

| | | | |
|---|---|---|---|
| 2,744,002 | 5/1956 | Crowley | 75/0.5 BA |
| 3,535,103 | 10/1970 | Whitfield | 75/0.5 BA |
| 3,623,861 | 11/1971 | Arias | 75/0.5 BA |
| 4,131,450 | 12/1978 | Saito | 75/0.5 BA |
| 4,612,039 | 9/1986 | Scheithauer | 75/0.5 BA |

*Primary Examiner*—Peter D. Rosenberg

*Attorney, Agent, or Firm*—Donald R. Castle; L. Rita Quatrini

[57] ABSTRACT

A chromium-cobalt alloy fine powder is disclosed which consists essentially of spheres with the chromium and cobalt being relatively uniformly distributed throughout the particles of the powder. The process for producing the powder is disclosed. The process involves firing a relatively uniform admixture consisting essentially of anhydrous cobalt (II) chloride and chromium (III) chloride in a furnace in a hydrogen atmosphere at a first temperature of at least about 400° C. and below the sublimation temperature of chromium (III) chloride for a time sufficient to reduce essentially all of the cobalt (II) chloride to cobalt metal and to reduce essentially all of the chromium (III) chloride to chromium (II) chloride. The temperature is elevated to a second temperature of at least about 750° C. and below the sublimation temperature of chromium (II) chloride. The elevation is done by raising the temperature in increments of about 100° C. and holding at the elevated temperature until the evolution of HCl gas ceases. The first reduced mixture is fired at the second temperature for a time sufficient to to reduce essentially all of the chromium (II) chloride to chromium metal without causing appreciable melting of the cobalt metal, to form the alloy powder which is then cooled in a non-oxidizing atmosphere.

4 Claims, No Drawings

CHROMIUM-COBALT FINE ALLOY POWDER AND PROCESS FOR PRODUCING SAME

BACKGROUND OF THE INVENTION

This invention relates to chromium-cobalt fine alloy powder and to the process for producing the powder by a two step reduction of a mixture of the chlorides of chromium and cobalt.

Fine powders of the more easily reduced metals such as iron, cobalt, nickel, and copper are typically prepared via the temperature controlled hydrogen reduction of the corresponding metal oxides. This method of preparation allows for precise control over such properties as particle size, surface area, and porosity of the metal powder. Alloy fine powders can similarly be prepared by reduction of mixed metal oxides. However, the hydrogen reduction of oxophilic metals such as chromium does not proceed significantly at temperatures below 1000° C. if the metal oxide is used as the starting material. Therefore, reduction of mixtures of oxides containing, for example, chromic oxide do not proceed to completion.

Chromium-cobalt metal alloys, in particular fine alloy powders are useful in cemented carbides. Therefore, a process to produce such alloys from chromium sources other than oxides and therefore at temperatures lower than 1000° C. would be desirable.

SUMMARY OF THE INVENTION

In accordance with one aspect of this invention there is provided a chromium metal alloy fine powder which is essentially spherical particles with the chromium and cobalt being relatively uniformly distributed throughout the particles of the powder.

In accordance with another aspect of this invention, there is provided a process for producing the above described alloy powder. The process involves firing a relatively uniform admixture consisting essentially of anhydrous cobalt (II) chloride and chromium (III) chloride in a furnace in a hydrogen atmosphere at a first temperature of at least about 400° C. and below the sublimation temperature of chromium (III) chloride for a time sufficient to reduce essentially all of the cobalt (II) chloride to cobalt metal and to reduce essentially all of the chromium (III) chloride to chromium (II) chloride. The temperature is elevated to a second temperature of at least about 750° C. and below the sublimation temperature of chromium (II) chloride. The elevation is done by raising the temperature in increments of about 100° C. and holding at the elevated temperature until the evolution of HCl gas ceases. The first reduced mixture is fired at the second temperature for a time sufficient to reduce essentially all of the chromium (II) chloride to chromium metal without causing appreciable melting of the cobalt metal, to form the alloy powder which is then cooled in a non-oxidizing atmosphere.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

By the process of this invention chromium-cobalt alloy fine powder which is essentially spherical particles with the chromium and cobalt being relatively uniformly distributed throughout each particle is produced by the hydrogen coreduction of the mixed anhydrous metal chlorides. Because of the lesser relative thermodynamic stability (with respect to the metal) of chromic chloride versus chromic oxide, the reduction of the chloride takes place under milder conditions, that is, at lower temperatures, than the reduction of the oxide.

The temperature profile of the reduction is crucial for the control of particle size in the resulting alloy powder.

The starting chromium and cobalt compounds to be reduced by the process of this invention are chromium (III) chloride and cobalt (II) chloride. The use of anhydrous materials as these chlorides eliminates oxygen contamination of the resulting alloy powder arising from the aquo ligands.

The anhydrous chlorides of both chromium and cobalt can be obtained commercially or prepared by known methods. Anhydrous cobalt (II) chloride is produced by thermal degradation of the hexahydrate. The anhydrous form of chromium (III) chloride can be synthesized directly by chlorination of chromium metal. Attempts to dehydate chromium (III) chloride hexahydrate result in the formation of chromic oxide.

The chlorides must be well mixed together in amounts appropriate to result in the desired composition of the resulting alloy powder. Anyone skilled in the art can formulate a mixture of the chlorides to produce the desired alloy composition. One suitable method of mixing the chlorides is to grind them together such as by means of a mortar and pestle. The mixing is preferably done in a dry inert atmosphere environment in order to prevent rehydration of the chlorides.

After the chlorides have been mixed sufficiently to result in formation of a relatively uniform admixture, they are loaded into reduction boats which are preferably graphite. The use of silica or alumina boats can possibly introduce undesirable impurities into the final alloy powder and therefore their use is preferably avoided.

The loaded boats are then introduced into a furnace which is typically preheated and maintained in a hydrogen atmosphere. The admixture of chlorides is fired in the furnace in the hydrogen atmosphere at a temperature of at least about 400° C. and below the sublimation temperature of chromium (III) chloride for a time sufficient to reduce essentially all of the cobalt (II) chloride to cobalt metal and to reduce essentially all of the chromium (III) chloride to chromium (II) chloride and form a first reduced mixture. The especially preferred temperature is about 530° C. which is below the sublimation temperature of chromium (III) chloride which is about 540° C. At the preferred temperature, the reduction of cobalt (II) chloride occurs somewhat slowly. Also reduction to chromium (II) chloride is essentially complete. Complete reduction to chromium metal requires higher temperatures. Generally this first stage in the reduction is judged to be complete by cessation of evolution of hydrogen chloride.

After this first reduction stage, the resulting first reduced mixture is fired in the hydrogen atmosphere at a temperature of at least about 750° C. and below the sublimation temperature of chromium (II) chloride for a time sufficient to reduce essentially all of the chromium (II) chloride to chromium metal without causing appreciable melting of the cobalt metal, and form the chromium-cobalt alloy fine powder.

According to this invention, after the first reduction stage, the temperature is elevated from the first reduction temperature to a second temperature to accomplish the reduction to chromium metal. This is done in increments of about 100° C. After each increment, the temperature is maintained for a period of time until the evolution of HCl gas ceases, to allow the reaction to proceed to the reduction to chromium metal. The temperature does not exceed about 850° C. which is the sublimation temperature of chromium (II) chloride.

A further complication of this second reduction stage is provided by the relatively low melting point of cobalt metal compared with chromium metal. At temperatures above about 600° C., the sintering of cobalt metal particles takes place rapidly. Although the presence of the chromium (II) chloride in the system inhibits the sintering process to some extent, care must be taken to minimize the amount of time that the resulting alloy powder product is exposed to temperatures above about 600° C. Hydrogen reduction is slow and the rate is temperature dependent. If the temperature rises too rapidly, the chromium (II) chloride will sublime and therefore the composition of the alloy powder product will vary from the desired composition. Cessation of evolution of hydrogen chloride is a sign that the reduction is complete and the heat is reduced when this point is reached.

Following this second reduction stage, the alloy powder is cooled to room temperature under a non-oxidizing gas such as hydrogen, nitrogen, or other inert atmosphere to prevent surface reoxidation of the alloy. It is then removed from the furnace.

The alloy powder product preferably has a particle size of from about 1 to about 2 microns in diameter.

To more fully illustrate this invention, the following non-limiting example is presented.

EXAMPLE

A quartz furnace tube is flushed with $N_2$ gas at about 10 cfm for about 0.5 hour and then with $H_2$ gas at about 10 cfm for about 0.5 hour. A sample consisting essentially of about 37.48 g $CoCl_2$ and about 9.14 g $CrCl_3$ is ground in a glass mortar until the mixture appears relatively uniform in color about 15 minutes. The chloride mixture is evenly divided between two graphite boats and the boats are placed in the quartz furnace tube which is then placed in a tube furnace which is preheated to about 530° C. The 10 cfm $H_2$ flow is maintained as the sample is heated according to the following reduction schedule: about 530° C. for about 2 hour, about 650° C. for about 1 hour, about 750° C. for about 0.5 hour, and about 850° C. for about 0.5 hour. Upon completion of the heating schedule, the tube is removed from the furnace and the sample is cooled under about 10 cfm $H_2$ gas flow. Elemental analysis of the resulting reduced sample by an x-ray fluorescence method determines that the resulting powder contains about 84.5% Co, and about 15.5% Cr by weight. Scanning electron micrographs show the powder to consist essentially of spherical particles of from about 1 to about 2 microns in diameter. Energy Dispersive Spectrometer (EDS) analysis of the same SEM photomicrographs indicates that the chromium and cobalt are relatively evenly dispersed in the particles.

While there has been shown and described what are at present considered the preferred embodiments of the invention, it will be obvious to those skilled in the art that various changes and modifications may be made therein departing from the scope of the invention as defined by the appended claims.

What is claimed is:

1. A process for producing a chromium-cobalt alloy fine powder, said powder being essentially spheres with said chromium and said cobalt being relatively uniformly distributed throughout the particles of said powder, said process comprising:

(a) firing a relatively uniform admixture consisting essentially of cobalt (II) chloride and chromium (III) chloride, with said cobalt (II) chloride and said chromium (III) chloride being in their respective anhydrous forms, in a furnace in a hydrogen atmosphere at a first temperature of at least about 400° C. and below the sublimation temperatures of chromium (III) chloride for a time sufficient to reduce essentially all of said cobalt (II) chloride to cobalt metal and to reduce essentially all of said chromium (III) chloride to chromium (II) chloride and form a first reduced mixture;

(b) elevating the temperature of said furnace to a second temperature of at least about 750° C. and below the sublimation temperature of chromium (II) chloride, the temperature elevation step being carried out by alternately raising the temperature of said furnace in increments of about 100° C. and holding the temperature of said furnace at the resulting elevated temperature for a period of time until the evolution of hydrogen chloride gas ceases, until said second temperature is reached, and firing said first reduced mixture in said furnace at said second temperature in a hydrogen atmosphere for a time sufficient to reduce essentially all of said chromium (II) chloride to chromium metal without causing appreciable melting of said cobalt metal, and form said chromium-cobalt alloy powder; and (c) cooling said alloy powder in a non-oxidizing atmosphere.

2. A process of claim 1 wherein said admixture is fired at a temperature of about 530° C.

3. A process of claim 1 wherein the particle size of said alloy powder is from about 1 to about 2 microns in diameter.

4. A product produced by the process of claim 1.

* * * * *